US006141642A

United States Patent [19]

Oh

[11] Patent Number: 6,141,642

[45] Date of Patent: Oct. 31, 2000

[54] TEXT-TO-SPEECH APPARATUS AND METHOD FOR PROCESSING MULTIPLE LANGUAGES

[75] Inventor: Chang-hwan Oh, Suwon, Rep. of Korea

[73] Assignee: SamSung Electronics Co., Ltd., Suwon, Rep. of Korea

[21] Appl. No.: 09/173,552

[22] Filed: Oct. 16, 1998

[30] Foreign Application Priority Data

Oct. 16, 1997 [KR] Rep. of Korea ..... 97-53020

[51] Int. Cl.[7] ..... G10L 11/04

[52] U.S. Cl. ..... 704/260; 704/277

[58] Field of Search ..... 704/1, 5, 7, 9, 704/10, 260, 277

[56] References Cited

U.S. PATENT DOCUMENTS

| | | | |
|---|---|---|---|
| 4,631,748 | 12/1986 | Breedlove et al. | 704/268 |
| 5,463,713 | 10/1995 | Hasegawa | 704/260 |
| 5,477,451 | 12/1995 | Brown et al. | 364/419.08 |
| 5,493,606 | 2/1996 | Osder et al. | 379/880.5 |
| 5,548,507 | 8/1996 | Martino et al. | 364/419.01 |
| 5,668,926 | 9/1997 | Karaali et al. | 704/232 |
| 5,751,906 | 5/1998 | Silverman | 704/260 |
| 5,758,320 | 5/1998 | Asano | 704/258 |
| 5,765,131 | 6/1998 | Stentiford et al. | 704/277 |
| 5,768,603 | 6/1998 | Brown et al. | 395/759 |
| 5,774,854 | 6/1998 | Sharman | 704/260 |
| 5,802,539 | 9/1998 | Daniels et al. | 704/542 |
| 5,805,832 | 9/1998 | Brown et al. | 704/2 |
| 5,806,033 | 9/1998 | Lyberg | 704/255 |
| 5,852,802 | 12/1998 | Breen et al. | 704/260 |
| 5,878,386 | 3/1999 | Coughlin | 704/10 |
| 5,900,908 | 5/1999 | Kirkland | 348/62 |
| 5,937,422 | 8/1999 | Nelson et al. | 707/531 |
| 5,940,793 | 8/1999 | Attwater et al. | 704/231 |
| 5,940,795 | 8/1999 | Matsumoto | 704/258 |
| 5,940,796 | 8/1999 | Matsumoto | 704/260 |
| 5,950,163 | 9/1999 | Matsumoto | 704/260 |
| 6,002,998 | 12/1999 | Martino et al. | 704/9 |

*Primary Examiner*—Krista Zele
*Assistant Examiner*—Michael N. Opsasnick
*Attorney, Agent, or Firm*—Robert E. Bushnell, Esq.

[57] ABSTRACT

A multiple language text-to-speech (TTS) processing apparatus capable of processing a text expressed in multiple languages, and a multiple language text-to-speech processing method. The multiple language text-to-speech processing apparatus includes a multiple language processing portion receiving multiple language text and dividing the input text into sub-texts according to language and a text-to-speech engine portion having a plurality of text-to-speech engines, one for each language, for converting the sub-texts divided by the multiple language processing portion into audio wave data. The processing apparatus also includes an audio processor for converting the audio wave data converted by the text-to-speech engine portion into an analog audio signal, and a speaker for converting the analog audio signal converted by the audio processor into sound and outputting the sound. Thus, the text expressed in multiple languages, which is common in dictionaries or the Internet, can be properly converted into sound.

23 Claims, 2 Drawing Sheets

TEXT-TO-SPEECH APPARATUS AND METHOD FOR PROCESSING MULTIPLE LANGUAGES

CLAIM OF PRIORITY

This application makes reference to, incorporates the same herein, and claims all benefits accruing under 35 U.S.C. §119 from an application entitled Multiple Language Tts Processing Apparatus and Method earlier filed in the Korean Industrial Property Office on the Oct. 16, 1997, and there duly assigned Serial No. 53020-1997, a copy of which is annexed hereto.

BACKGROUND OF THE INVENTION

1. Technical Field

The present invention relates to a text-to-speech (TTS) processing apparatus, and more particularly, to a multiple language text-to-speech processing apparatus capable of processing texts expressed in multiple languages of many countries, and a method thereof.

2. Related Art

A text-to-speech device is a device which is able to detect words and then convert the words into audible sounds corresponding to those words. In other words, a text-to-speech device is able to detect text, such as text appearing in a book or on a computer display, and then output audible speech sounds corresponding to the detected text. Thus, the device is known as a "text-to-speech" device.

Exemplars of recent efforts in the art include U.S. Pat. No. 5,751,906 for a Method for Synthesizing Speech from Text and for Spelling All or Portions of the Text by Analogy issued to Silverman, U.S. Pat. No. 5,758,320 for Method and Apparatus for Text-to-voice Audio Output with Accent Control and Improved Phrase Control issued to Asano, U.S. Pat. No. 5,774,854 for a Text to Speech System issued to Sharman, U.S. Pat. No. 4,631,748 for an Electronic Handheld Translator Having Miniature Electronic Speech Synthesis Chip issued to Breedlove et al., U.S. Pat. No. 5,668,926 for Method and Apparatus for Converting Text into Audible Signals Using a Neural Network issued to Karaali et al., U.S. Pat. No. 5,765,131 for a Language Translation System and Method issued to Stentiford ct al., U.S. Pat. No. 5,493,606 for a Multi-lingual Prompt Management System for a Network Applications Platform issued to Osder et al., and U.S. Pat. No. 5,463,713 for a Synthesis of Speech from Text issued to Hasegawa.

While these recent efforts provide advantages, I note that they fail to adequately provide a text-to-speech system which is able to generate speech for text when the text appears in several different languages.

SUMMARY OF THE INVENTION

To solve the above problem, it is an objective of the present invention to provide a multiple language text-to-speech (TTS) apparatus capable of generating appropriate sound with respect to a multiple language text, and a method thereof.

According to an aspect of the above objective, there is provided a multiple language text-to-speech (TTS) processing apparatus comprising: a multiple language processing portion for receiving a multiple language text and dividing the input text into sub-texts according to language; a text-to-speech engine portion having a plurality of test-to-speech engines, one for each language, for converting the sub-texts divided by the multiple language processing portion into audio wave data; an audio processor for converting the audio wave data converted by the text-to-speech engine portion into an analog audio signal; and a speaker for converting the analog audio signal converted by the audio processor into sound and outputting the sound.

According to another aspect of the above objective, there is provided a multiple language text-to-speech (TTS) processing method for converting a multiple language text into sound, comprising the steps of: (a) checking characters of an input multiple language text one by one until a character of a different language from the character under process is found; (b) converting a list of the current characters checked in the step (a) into audio wave data which is suitable for the character under process; (c) converting the audio wave data converted in the step (b) into sound and outputting the sound; and (d) repeating the steps (a) through (c) while replacing the current processed language by the different language found in the step (a), if there are more characters to be converted in the input text.

To achieve these and other objects in accordance with the principles of the present invention, as embodied and broadly described, the present invention provides a text-to-speech apparatus converting text of multiple languages into sounds corresponding to human speech, comprising: a processing system receiving multiple language text, said multiple language text including text of a plurality of languages, said processing system segregating said multiple language text into a plurality of groups of text, each one group among said plurality of groups including text corresponding to only one language selected from among said plurality of languages; a text-to-speech engine system receiving said plurality of groups of text from said processing system, said text-to-speech engine system including a plurality of text-to-speech engines, each one text-to-speech engine among said plurality of text-to-speech engines corresponding to one language selected from among said plurality of languages, said text-to-speech engine system converting said plurality of groups of text into audio wave data; an audio processor unit receiving said audio wave data and converting said audio wave data into analog audio signals; and a speaker receiving said analog audio signals and converting said analog audio signals into sounds and outputting the sounds, wherein the sounds correspond to human speech.

To achieve these and other objects in accordance with the principles of the present invention, as embodied and broadly described, the present invention provides a text-to-speech processing method converting text of multiple languages into sounds corresponding to human speech, comprising the steps of: (a) receiving a character of multiple language text and storing said character in a buffer, said multiple language text including text of a plurality of languages, wherein said character is among a plurality of characters of said multiple language text; (b) identifying a first language among said plurality of languages corresponding to said character received in said step (a), said first language being considered as a current language; (c) receiving a next character among said plurality of characters, and identifying a next language among said plurality of languages corresponding to said character received in said step (c); (d) when said next language identified in said step (c) does not correspond to said current language, converting said characters stored in said buffer into corresponding audio wave data and converting said audio wave data into sound and outputting the sound, wherein the sound corresponds to human speech, and then clearing said buffer, storing said character received in said step (c) in said buffer, replacing said current language with said next language identified in said step (c) to cause said next language identified in said step (c) to be now considered as said current language, and repeating said method beginning at said step (c) until all characters of said multiple language text have been converted to sound; and (e) when said next language identified in said step (c) does correspond to said current language, storing said character received in said step (c) in said buffer, and repeating said method beginning at said step (c) until all characters of said multiple language text have been converted to sound.

To achieve these and other objects in accordance with the principles ofthe present invention, as embodied and broadly described, the present invention provides a text-to-speech processing method converting text of multiple languages into sounds corresponding to human speech, comprising the steps of: (a) temporality storing a first plurality of received characters corresponding to a first language in a first predetermined buffer until a character corresponding to a second language is input, wherein a first character of an input multiple language text corresponds to said first language, said multiple language text including text of said first and second languages; (b) converting said plurality of received characters corresponding to said first language, temporarily stored in said first predetermined buffer in said step (a), into sound using a first language text-to-speech engine; (c) temporarily storing a second plurality of received characters corresponding to said second language in a second predetermined buffer until a character corresponding to said first language is input; (d) converting said plurality of received characters corresponding to said second language, temporarily stored in said second predetermined buffer in said step (c), into sound using a second language text-to-speech engine; and (e) repeating said steps (a) through (d) until all received characters of said multiple language text have been converted to sound.

The present invention is more specifically described in the following paragraphs by reference to the drawings attached only by way of example. Other advantages and features will become apparent from the following description and from the claims.

BRIEF DESCRIPTION OF THE DRAWINGS

A more complete appreciation ofthe present invention, and many ofthe attendant advantages thereof, will become readily apparent as the same becomes better understood by reference to the following detailed description when considered in conjunction with the accompanying drawings in which like reference symbols indicate the same or similar components, wherein.

DESCRIPTION OF THE PREFERRED EMBODIMENT

Figure 1:
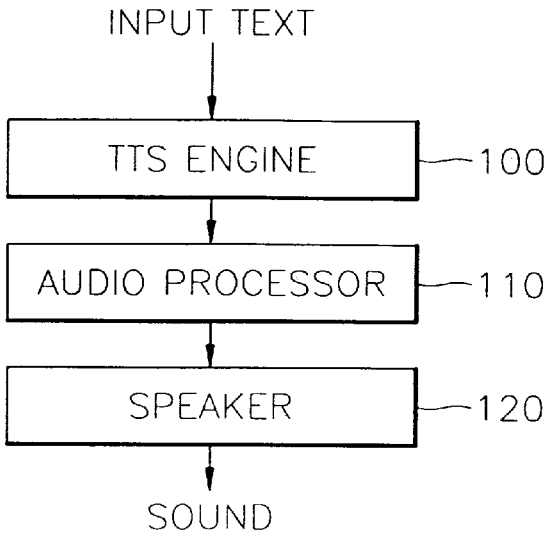
FIG. 1 shows the structure of a text-to-speech (TTS) processing apparatus.

Turn now to FIG. 1, which illustrates the structure of a text-to-speech (TTS) processing apparatus. A text expressed in one predetermined language is converted into audio wave data by a text-to-speech (TTS) engine 100, the audio wave data converted by the text-to-speech (TTS) engine 100 is converted into an analog audio signal by an audio processor 110, and the analog audio signal converted by the audio processor 110 is output as sound via a speaker 120.

However, the text-to-speech (TTS) processing apparatus of FIG. 1 can only generate appropriate sound with respect to text expressed in a single language. For example, when the TTS processing apparatus of FIG. 1 corresponds to a Korean TTS, then the Korean TTS can generate appropriate sounds corresponding to text only when the text appears in the Korean language. However, the Korean TTS cannot generate appropriate sounds corresponding to text when the text appears in the English language.

Alternatively, when the TTS processing apparatus of FIG. 1 corresponds to an English TTS, then the English TTS can generate appropriate sounds corresponding to text only when the text appears in the English language. However, the English TTS cannot generate appropriate sounds corresponding to text when the text appears in the Korean language. Therefore, the text-to-speech (TTS) processing apparatus of FIG. 1 cannot generate appropriate sound with respect to a text expressed in many languages, that is, a multiple language text.

Figure 2:
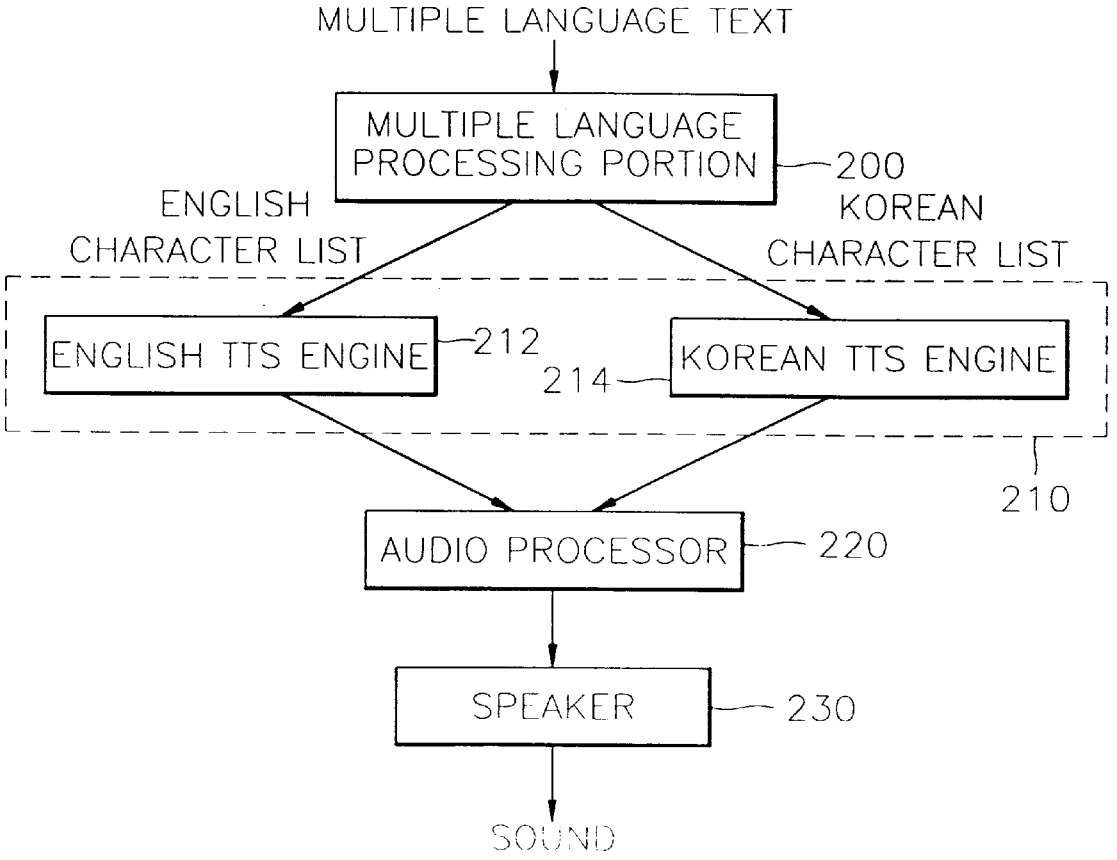
FIG. 2 shows the structure of a text-to-speech (TTS) processing apparatus for Korean and English text, in accordance with the principles of the present invention.

Turn now to FIG. 2, which illustrates the structure of a text-to-speech (TTS) processing apparatus for Korean and English text, in accordance with the principles of the present invention. As shown in FIG. 2, the text-to-speech (TTS) processing apparatus for Korean and English text comprises a multiple language processing portion 200, a text-to-speech (TTS) engine portion 210, an audio processor 220 and a speaker 230. The multiple language processing portion 200 receives the Korean and English text, and divides the input multiple language text into Korean sub-text and English sub-text.

Figure 3:
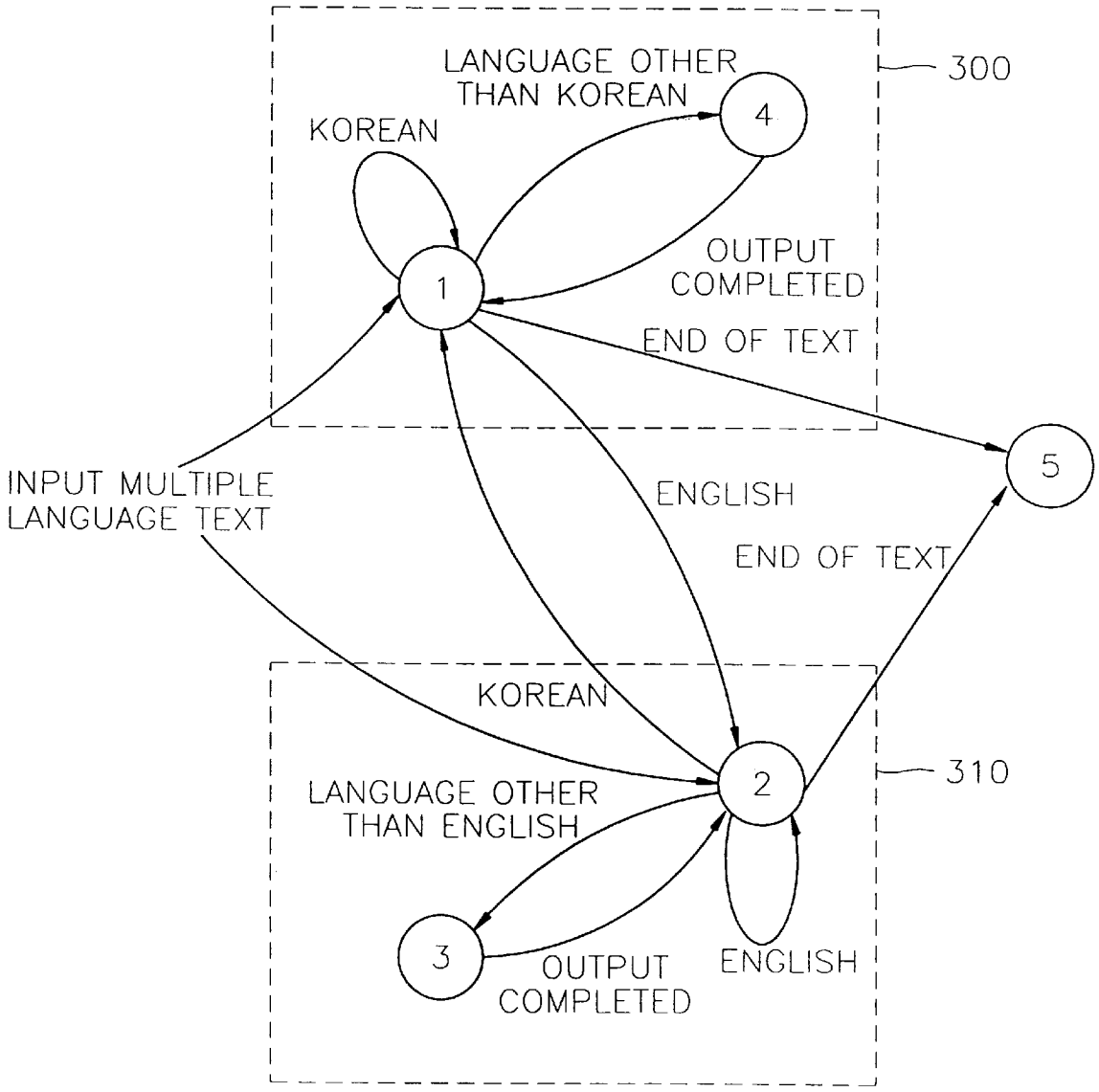
FIG. 3 is a diagram illustrating the operational states ofthe text-to-speech (TTS) processing apparatus shown in FIG. 2, in accordance with the principles of the present invention.

Turn now to FIG. 3, which illustrates the operational states of the text-to-speech (TTS) processing apparatus shown in FIG. 2, in accordance with the principles of the present invention. The text-to-speech (TTS) processing apparatus of FIG. 2 for the Korean and English text comprises two processors, that is, a Korean processor 300 and an English processor 310, as shown in FIG. 3.

One ofthe Korean and English processors 300 and 310 receives the Korean and English text in character units, and the input text is transferred to the corresponding text-to-speech (TTS) engine of the text-to-speech (TTS) engine portion 210. In other words, when the text is Korean text, the Korean processor 300 receives the Korean text in character units. When the text is English text, the English processor 310 receives the English text in character units.

When a character of the other language is detected, the one language processor transfers its control to the other language processor, for processing the newly detected language. Here, the multiple language processing portion 200 may additionally include language processors for other languages, as different languages are added. Thus, three or more language processors can be included within the multiple language processor 200 and three or more TTS engines can be provided in the TTS engine portion 210.

For example, the multiple language processing portion can simultaneously include an English processor, Korean processor, Japanese processor, French processor, German processor, and a Mandarin Chinese processor. In this manner, the text-to-speech apparatus of the present invention could transfer text from any one of these six languages to appropriate speech.

The text-to-speech (TTS) engine portion 210 comprises a Korean TTS engine 214 and an English TTS engine 212. The Korean engine 214 can be considered a primary engine and the English engine 212 can be considered a secondary engine. The Korean TTS engine 214 converts the Korean character list received from the multiple language processing portion 200, into the Korean audio wave data, and the English TTS engine 212 converts the English into the English audio wave data. The English and Korean TTS engines 212 and 214 convert the input text, expressed in a predetermined language, into audio wave data through a lexical analysis step, a radical analysis step, a parsing step, a wave matching step and an intonation correction step. The text-to-speech (TTS) engine portion 210 may further comprise other TTS engines for other languages as extra languages are added, as in the case of the multiple language processing portion 200.

The audio processor 220 converts the audio wave data converted by the text-to-speech (TTS) engine portion 210 into an analog audio signal. The audio processor 220 corresponds to the audio processor 110 of the text-to-speech (TTS) processing apparatus shown in FIG. 1. In general, the audio processor 220 includes an audio driver as a software module and an audio card as a hardware block. The speaker 230 converts the analog audio signal output from the audio processor 220 into sound, and outputs the sound.

Referring to FIG. 3, the text-to-speech (TTS) processing of Korean and English text forms a finite state machine (FSM). The finite state machine (FSM) includes five states 1, 2, 3, 4 and 5, represented by numbered circles in FIG. 3. For example, the state 1 is represented by the number 1 enclosed in a circle shown in FIG. 3, in the Korean processor 300.

First, when Korean and English text is input, the state 1 controls the process. The state 1 is shown within the Korean code region of the Korean processor 300. In the state 1, a character to be processed is read from the input multiple language text, and a determination of whether or not the character code belongs to the Korean code region is made. If the character code belongs to the Korean code region, the state 1 is maintained. However, if the character code does not belong to the Korean code region, the state is shifted to the state 4 for conversion into sound and output of the previously stored sound. After outputting the previously stored sound in the state 4., if the character code belongs to the English code region, the state is shifted to the state 2. If the end of the multiple language text is identified, the state is shifted to the state 5.

In the state 2, a character to be processed is read from the input multiple language text, and a determination of whether or not the character code belongs to the English code region is made. If the character code belongs to the English code region, the state 2 is maintained. The state 2 is shown within the English code region of the English processor 310. However, if the character code does not belong to the English code region, the state is shifted to the state 3 for conversion into sound and output of the previously stored sound. After outputting the previously stored sound in the state 3, if the character code belongs to the Korean code region, the state is shifted to the state 1. If the end of the multiple language text is identified, the state is shifted to the state 5.

Here, the determination of whether the read character code belongs to the Korean code region or English code region in the states 1 and 2 is performed using the characteristics of 2-byte Korean coding.

In the state 3, the current English character list is converted into audio wave data using the English TTS engine 212, and the English sound is output via the audio processor 220 and the speaker 230. The state 3 is shown within the English code region of the English processor 310. Then, the state returns to the state 2.

In the state 4, the current Korean character list is converted into audio wave data using the Korean TTS engine 214, and the Korean sound is output via the audio processor 220 and the speaker 230. The state 4 is shown within the Korean code region of the Korean processor 300. Then, the state returns to the state 1.

In the state 5, the text-to-speech (TTS) process on the multiple language text is completed.

As an example, shown below is an illustration of the method that multiple language text is processed by the text-to-speech (TTS) process in accordance with the principles of the present invention, with reference to FIGS. 2 and 3. For this example, presume that a multiple language text of "나는man 이다" is input. The "나" and "는" and "이" and "다" are characters in the Korean language. The "m" and "a" and "n" are characters in the English language. Note that the multiple language text "나는 man 이다" corresponds to the English phrase "I am a man". The text-to-speech (TTS) process is performed as follows, in accordance with the principles of the present invention.

First, in the initial state, that is, in the state 1, the character received is checked to determine whether the first input character is Korean or English. If a character "나" is input in the state 1, there is no state shift because the input character is Korean. Next, when a character "는" is input, the state 1 is maintained because the input character is Korean again. When the character "m" is input in the state 1, the state 1 is shifted to the state 4 and the current character list "나는" stored in a buffer is output as sound, and the state returns to the state 1. Then control is transferred from the state 1 to the state 2 together with the input English character "m".

In the state 2, the character "m" transferred from the state 1 is temporarily stored in a predetermined buffer. Then, characters "a" and "n" are continuously input and then temporarily stored in the buffer. Then, when the character "이" is input in the state 2, the state 2 is shifted to the state 3 to output the current character list "man" stored in the buffer as sound. Then, the state 3 returns to the state 2, and control is transferred from the state 2 to the state 1 together with the input Korean character "이".

In the state 1, the character "이" transferred from the state 2 is temporarily stored in a predetermined buffer. Then, a character "나" is input and then temporarily stored in the buffer. Next, if the end of the input text is identified in the state 1, the state 1 is shifted to the state 4 to output the current character list "이다" stored in the buffer as sound. Then, the state 4 returns to the state 1. Because there is no character to be processed in the input text, control is, transferred from by the state 1 to the state 5 to terminate the process.

As more languages form the multiple language text, for example, Japanese, Latin, and Greek, the number of states forming the finite state machine (FSM) can be increased. Also., the individual languages of the multiple language text can be easily discriminated if the unicode system becomes well-established in the future.

According to the present invention, the multiple language text, which is common in dictionaries or the Internet, can be properly converted into sound. According to the present invention, multiple language text can be converted to speech, wherein the multiple language text can include text of languages including Korean, English, Japanese, Latin, Greek, German, French, Italian, Mandarin Chinese, Russian, Spanish, Swedish, and other languages.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An apparatus, comprising:

a processing system receiving multiple language text corresponding to text of a plurality of languages including first and second text characters;

a text-to-speech engine system receiving said text from said processing system, said text-to-speech engine system having a plurality of text-to-speech engines including a first language engine and a second language engine, each one text-to-speech engine among said plurality of text-to-speech engines corresponding to one language selected from among said plurality of languages, said text-to-speech engine system converting said text into audio wave data;

an audio processor unit receiving said audio wave data and converting said audio wave data into analog audio signals;

a speaker receiving said analog audio signals and converting said analog audio signals into sounds and outputting the sounds, wherein the sounds correspond to human speech;

said processing system receiving said first text character and determining a first language corresponding to said first character, said first language being selected from among said plurality of languages;

said first language engine receiving said first character outputted from said processing system and adding said first character to a buffer;

said processing system receiving said second text character and determining a second language corresponding to said second character, said second language being selected from among said plurality of languages;

said speaker outputting contents of said memory in form of the sounds corresponding to human speech when said first language of said first text character does not correspond to said second language of said second text character; and said second language engine receiving said second character outputted from said processing system and deleting contents of the buffer and adding said second character to the buffer, when said first language does not correspond to said second language.

2. The apparatus of claim 1, wherein said processing system further comprises a plurality of language processing units including first and second language processing units, each one language processing unit among said plurality of language processing units receiving one language selected from among said plurality of languages, said first language processing unit receiving said multiple language text when said multiple language text corresponds to the language of said first language processing unit.

3. The apparatus of claim 2, wherein said processing system transfers control to said second language processing unit when said multiple language text corresponds to the language of said second language processing unit.

4. The apparatus of claim 1, wherein said multiple language text further comprises a plurality of characters.

5. The apparatus of claim 4, wherein said processing system further comprises a plurality of language processing units including first, second, and third language processing units, each one language processing unit among said plurality of language processing units receiving one language selected from among said plurality of languages, said first language processing unit receiving said plurality of characters of said multiple language text when said plurality of characters corresponds to the language of said first language processing unit.

6. The apparatus of claim 5, wherein said processing system transfers control to said second language processing unit when said plurality of characters of said multiple language text corresponds to the language of said second language processing unit.

7. The apparatus of claim 6, wherein said processing system transfers control to said third language processing unit when said plurality of characters of said multiple language text corresponds to the language of said third language processing unit.

8. The apparatus of claim 7, wherein said first language processing unit corresponds to Korean language, said second language processing unit corresponds to English language, and said third language processing unit corresponds to Japanese language.

9. The apparatus of claim 1, wherein said plurality of languages includes languages selected from among Korean, English, Japanese, Latin, Greek, German, French, Italian, Mandarin Chinese, Spanish, and Swedish.

10. A method, comprising the steps of:

receiving a first character of multiple language text and storing said first character in a buffer, said multiple language text of a plurality of languages including first and second languages;

determining that said first language corresponds to said first character, and setting said first language as a current language;

receiving a second character of said multiple language text, and determining that said second language corresponds to said second character;

when said second language does correspond to the current language, storing said second character in said buffer; and when said second language does not correspond to the current language, converting said first character stored in said buffer into corresponding audio wave data and converting said audio wave data into sound corresponding to human speech and outputting the sound, and then clearing said buffer and storing said second character in said buffer and setting said second language as the current language.

11. The method of claim 10, wherein said plurality of languages includes languages selected from among Korean, English, Japanese, Latin, Greek, German, French, Italian, Mandarin Chinese, Russian, Spanish, and Swedish.

12. The method of claim 10, wherein said step of storing said second character in said buffer when said second language does correspond to the current language further comprises:

receiving a third character among said plurality of characters, and identifying a third language among said plurality of languages corresponding to said third character, wherein said third character is among said plurality of characters of said multiple language text;

when said third language does correspond to the current language, storing said third character in said buffer; and when said third language does not correspond to the current language, converting said first and second characters stored in said buffer into corresponding audio wave data and converting said audio wave data into sound corresponding to human speech and outputting the sound, and then clearing said buffer and storing said third character in said buffer and causing said third language to be considered as the current language.

13. The method of claim 10, further comprising a plurality of language processing units, each one of said language processing units receiving one language selected from among said plurality of languages, a first language processing unit receiving said multiple language text when said multiple language text corresponds to the language of said first language processing unit, said first language processing unit being among said plurality of language processing units.

14. The method of claim 13, wherein said step of storing said second character in said buffer when said second language does correspond to the current language further comprises:

receiving a third character among said plurality of characters, and identifying a third language among said plurality of languages corresponding to said third character, wherein said third character is among said plurality of characters of said multiple language text;

when said third language does correspond to the current language, storing said third character in said buffer; and when said third language does not correspond to the current language, converting said first and second characters stored in said buffer into corresponding audio wave data and converting said audio wave data into sound corresponding to human speech and outputting the sound, and then clearing said buffer and storing said third character in said buffer and causing said third language to be considered as the current language.

15. The method of claim 13, further comprising converting said audio wave data into analog audio signals.

16. The method of claim 15, further comprising receiving said analog audio signals and converting said analog audio signals into sound and then outputting the sound.

17. A converting text of method, comprising the steps of:

temporarily storing a first plurality of received characters corresponding to a first language in a first predetermined buffer until a new character corresponding to a second language is input, wherein a first character of an input multiple language text corresponds to said first language, said multiple language text including text of said first and second languages;

when said new character corresponding to said second language distinguishable from said first language is input, converting said first plurality of received characters corresponding to said first language into sound using a first language text-to-speech unit;

temporarily storing a second plurality of received characters corresponding to said second language in a second predetermined buffer until a character corresponding to said first language is input, said new character being among said second plurality of received characters; and converting said second plurality of received characters corresponding to said second language into sound using a second language text-to-speech unit.

18. The method of claim 17, wherein said first and second languages are selected from among Korean, English, Japanese, Latin, Greek, German, French, Italian, Mandarin Chinese, Russian, Spanish, and Swedish.

19. The method of claim 17, further comprising an audio processor unit receiving audio wave data from said first and second language text-to-speech units and converting said audio wave data into analog audio signals.

20. The method of claim 19, further comprising converting said analog audio signals into sound and then outputting the sound.

21. A method, comprising the sequential steps of:

setting a speech unit to process an initial language selected from among a plurality of human languages;

receiving a first text character;

determining a first language corresponding to said first received character;

when said first language does correspond to said initial language, adding said first character to a memory;

when said first language does not correspond to said initial language, setting said speech unit to process said first language and adding said first character to said memory;

receiving a second text character;

determining a second language corresponding to said second received character;

when said second language does correspond to said first language, adding said second character to said memory;

when said second language does not correspond to said first language, outputting contents of said memory in form of audible speech corresponding to said contents of memory and deleting said contents of said memory and setting said speech unit to process said second language and adding said second character to said memory;

receiving a third text character;

determining a third language corresponding to said third received character;

when said third language does correspond to said second language, adding said third character to said memory; and when said third language does not correspond to said second language, outputting contents of said memory in form of audible speech corresponding to said contents of said memory and deleting said contents of said memory and setting said speech unit to process said third language and adding said third character to said memory, said first, second, and third languages being selected from among said plurality of human languages.

22. A method of receiving text including characters of multiple languages and converting the text into sounds corresponding to human speech, comprising:

receiving a first text character;

determining a first language corresponding to said first received character, said first language corresponding to a language selected from among a plurality of languages of humans;

when said first language does correspond to an initial language setting of a speech unit, adding said first character to a memory;

when said first language does not correspond to said initial language, setting said speech unit to process said first language and adding said first character to said memory;

receiving a second text character;

determining a second language corresponding to said second received character, said second language corresponding to a language selected from among said plurality of languages of humans;

when said second language does correspond to said first language, adding said second character to said memory; and when said second language does not correspond to said first language, outputting contents of said memory in form of audible speech corresponding to said contents of memory and deleting said contents of said memory and setting said speech unit to process said second language and adding said second character to said memory.

23. An apparatus, comprising:

a text-to-speech system receiving text including characters of multiple human languages and converting the text into sounds corresponding to human speech, said system comprising:

a language processing unit receiving a first text character and determining a first language corresponding to said first received character, said first language being selected from among a plurality of human languages;

a first language engine receiving said first character outputted from said language processing unit and adding said first character to a buffer;

said language processing unit receiving a second text character and determining a second language corresponding to said second character, said second language being selected from among said plurality of human languages;

a speaker outputting contents of said memory in form of audible speech when said first language of said first text character does not correspond to said second language of said second text character; and a second language engine receiving said second character outputted from said language processing unit and deleting contents ofthe buffer and adding said second character to the buffer, when said first language does not correspond to said second language.

* * * * *